United States Patent [19]

Iwata et al.

[11] 4,437,811

[45] Mar. 20, 1984

[54] SUBMERSIBLE PUMP WITH ALTERNATE PUMP OPERATION CONTROL MEANS

[75] Inventors: Minoru Iwata, Chigasaki; Yukio Murata, Fujisawa; Tomoyuki Shibata, Yokohama, all of Japan

[73] Assignee: Ebara Corporation and Ebara Densan, Ltd., Tokyo, Japan

[21] Appl. No.: 163,948

[22] Filed: Jun. 30, 1980

[51] Int. Cl.³ ..... F04B 49/04

[52] U.S. Cl. ..... 417/8; 417/36; 417/40

[58] Field of Search ..... 417/8, 2–7, 417/36, 40, 44; 307/118; 137/392; 415/1

[56] References Cited

U.S. PATENT DOCUMENTS

| | | | |
|---|---|---|---|
| 2,797,702 | 7/1957 | Martin | 137/392 |
| 3,424,370 | 1/1969 | Law | 415/1 |
| 3,568,121 | 3/1971 | Nash | 417/36 X |
| 3,741,683 | 6/1973 | McTamaney et al. | 417/7 |
| 3,744,932 | 7/1973 | Prevett | 417/8 |
| 4,171,186 | 10/1979 | Chapman | 417/40 X |
| 4,179,242 | 12/1979 | Tateshita et al. | 417/8 |
| 4,222,711 | 9/1980 | Mayer | 417/36 X |
| 4,297,081 | 10/1981 | Irvin | 417/8 X |

FOREIGN PATENT DOCUMENTS

| | | | |
|---|---|---|---|
| 52-14837 | 4/1977 | Japan . | |
| 53-8921 | 4/1978 | Japan . | |
| 54-97801 | 8/1979 | Japan | 417/8 |

*Primary Examiner*—Edward K. Look

*Attorney, Agent, or Firm*—Oblon, Fisher, Spivak, McClelland & Maier

[57] ABSTRACT

A submersible pump adapted to pump out the liquid in a reservoir has a built-in control unit for alternate pump operation. The control unit includes step memory means which provides a signal to permit the starting of pump operation every other time a high liquid level sensor senses the liquid. Once started, the pump continues its operation until the liquid level drops below a low liquid level sensor. The submersible pump can be combined with an additional pump having a conventional control unit in which case the two pumps are alternately operated.

10 Claims, 8 Drawing Figures

SUBMERSIBLE PUMP WITH ALTERNATE PUMP OPERATION CONTROL MEANS

FIELD OF THE INVENTION

This invention relates to liquid level control and more particularly to a submersible pump with alternate pump operation control means so that the pump is alternately switched into operation relative to another pump in order to empty a reservoir or the like.

STATE OF THE ART

A submersible pump adapted to lower the liquid level in a reservoir is conventionally controlled by a liquid level sensing control having two spaced liquid level sensors so that operation of the pump starts when the liquid reaches a level detected by the high level sensor and continues its pumping operation until the liquid falls down to a level defined by the low level sensor.

The Japanese Patent Publication No. 8921/78 issued on Apr. 1, 1978 discloses a submersible pump which is put into operation every other time the liquid reaches a certain level. The pump includes a built-in liquid level control having a stepping relay of a two-position type. The stepping relay responds to the output of the low-level sensor; the position of the stepping relay is moved from first position to second position or vice versa each time the low-level sensor detects the liquid. The first position conditions the pump to be activated upon the subsequent detection of the high-level sensor. The second position prevents the pump from being energized against the detection of the high-level sensor. When applied to a two-pump level control system, the pump is alternately operated relative to the additional pump of the type which, as a single pump, operates between two spaced liquid levels. However, in order that this alternate operation can be done, limitations on the operating levels between the pumps must be considered. More specifically, the level at which the afore-mentioned stepping relay is moved must be higher than the level at which the additional pump stops. Otherwise, the stepping relay can not be moved during the operations of the additional pump, with the result being that only the additional pump is operated and no such alternate operation between the pumps is attained. The Japanese Patent Publication No. 14837/77, issued on Apr. 25, 1977 discloses a level control system wherein two pumps are employed and are alternately operated. In this system, a solid state control circuit is used instead of an electric-mechanical relay circuit as disclosed in the aforementioned Patent Publication No. 8921/78, and a binary stable is used instead of the afore-mentioned stepping relay. However, as far as the control logic is concerned, this system is similar to the system of Patent Publication No. 8921/78. Thus, limitations on the liquid levels also make it difficult to install the associated level sensors. Further, the out-of-horizontal bottom surface of the reservoir causes the troublesome adjustment in position of the liquid level sensors and a complicated installation of the pumps.

SUMMARY OF THE INVENTION

It is an object of the present invention to provide a pump with alternate pump operation control means which does not require any specific consideration in installing its liquid level sensors; the low level sensor of the pump can be located either higher or lower than the level at which the additional pump stops.

Another object of this invention is to provide a liquid level control system wherein two pumps can be alternately operated regardless of whether the liquid level sensor for stopping one of the pumps is located above or below the low level sensor for stopping the other pump.

The main feature of the present invention resides in the use of step memory means which is changed between the two states each time it receives a signal from the high liquid level sensor rather than from the low liquid level sensor. The output of the step memory conditions the control to alternately start the pump operation in response to the signal from the high liquid level sensor.

In one embodiment wherein a mechanical relay technique is employed, the step memory comprises a stepping relay in response to the high liquid level signal. The contact of the stepping relay is changed between the open and closed positions each time the relay coil is energized by the high liquid level signal. For example, if the stepping relay is changed to the closed position by a first coming of the high liquid level signal, it will be changed to the open position by the next signal. The third signal will switch the stepping relay back to the closed position. The contact is latched in position after the relay coil is deenergized until the coil is energized again.

In another embodiment wherein a solid state circuit technique is employed, the step memory comprises a bistable flip flop which responds to the high liquid level signal. The state of the flip flop is changed each time it receives the signal from the high liquid level signal. Thus, the flip flop operates in a manner similar to the stepping relay as described.

BRIEF DESCRIPTION OF THE DRAWINGS

Other objects, features and advantages of the invention will be apparent from the following description with reference to the drawings in which.

DETAILED DESCRIPTION OF THE PREFERRED EMBODIMENTS

Figure 1:
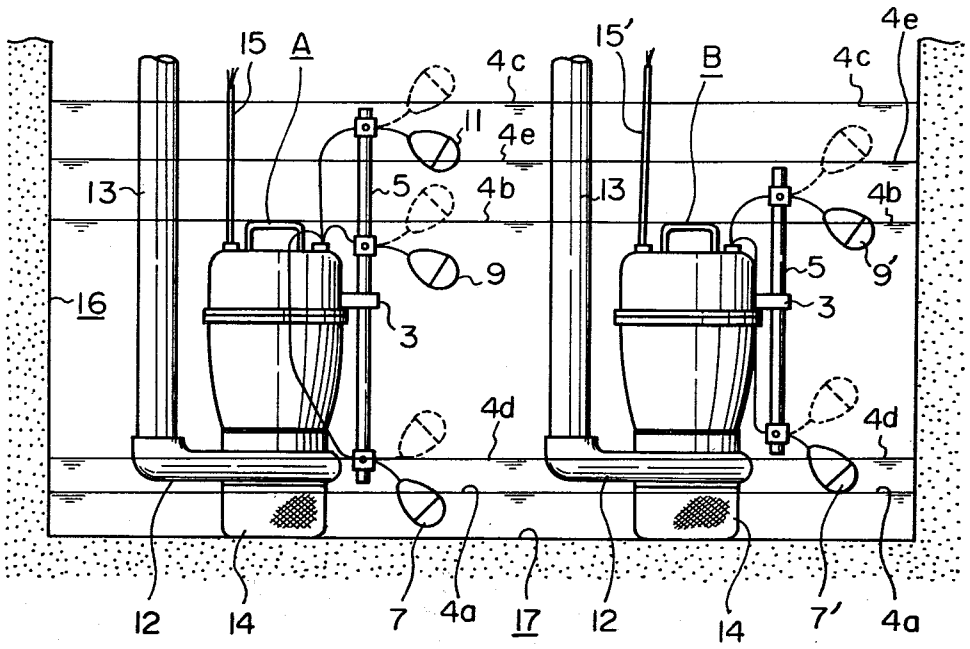
FIG. 1 is a schematic view of a pump control system including two pumps in accordance with the present invention.

Referring now to the drawings and particularly to FIG. 1, there is shown a schematic view of a system for controlling the liquid level in a reservoir. The system includes two pumps designated by A and B. The pumps are employed to empty the liquid in a tank defined by side walls 16 and a bottom 17. It should be noted that the pump A has a built-in alternate pump operation control unit in the upper housing thereof. The details will be described later.

Both pumps includes liquid level sensors of the float type as shown. The float sensor 9 is a high level sensor of the pump A while the float sensor 7 spaced below the sensor 11 is a low level sensor. Similarly, the float sensor 9' is a high level sensor of the pump B while the float sensor 7' is a low level sensor thereof. As a single pump, the pump B operates in a conventional manner; that is, the operation of pump B is always started when its high level sensor 9' senses the liquid and continues its pumping until the liquid falls down to the level 4 at which the low level sensor 7' signals the control circuit to stop the pump. On the other hand, pump A is alternately started into operation when its high level sensor 9' is submerged in the liquid and continues its pumping until the low level float 7 is out of the liquid. The lines 4*a*, 4*b*, 4*c*, 4*d*, 4*e* defines the operating levels at which the respective sensors are turned on or off as the case may be. Each float is oriented downwardly whenever it is out of the liquid as shown in solid lines. However, when submerged into the liquid, the orientation of each float is changed to an upward direction as shown by the phantom lines. The floats are supported on a rod 5 which is supported on the respective pump via a bracket 3.

Each pump has an inlet 14 through which liquid enters into the pump and discharges through an outlet 12 which communicates with an outlet conduit 13.

Electric power to the motor of the pump and to the control circuit built therein is supplied via a cable 15.

In the embodiment, the operating level 4*a* of the low level sensor 7 of the subsystem A is located above the operating level 4*d* of the low level sensor 7' of the subsystem B. However, the level relationship between the low level sensors 7 and 7' can be reversed in accordance with the present invention.

As described, in the prior art the level 4*a* must be higher than the level 4*d* at which the pump B stops in order to assure the alternate pump operation.

Figure 2:
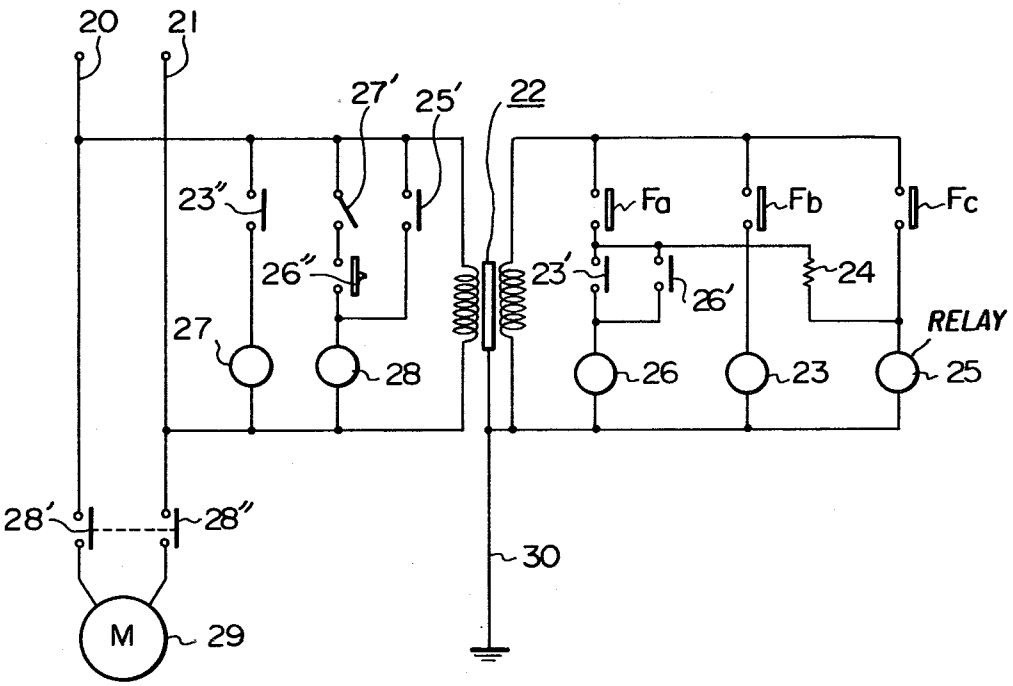
FIG. 2 is a schematic electrical diagram of a control circuit suitable for one pump as shown in FIG. 1.

Referring now to FIG. 2, there is shown an embodiment of an alternate pump operation control circuit in a diagram form in accordance with the present invention.

Figure 3:
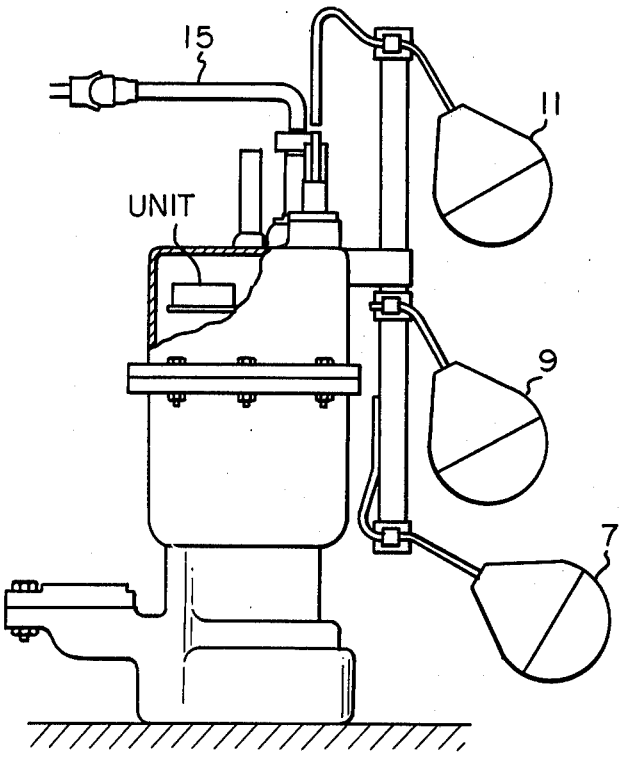
FIG. 3 is an elevational view of the one pump which is partly broken to illustrate the location of a built-in control circuit unit such as the circuits shown in FIGS. 7 and 8.

This control circuit unit may be incorporated into the upper housing of pump A in FIG. 1 in a manner as shown in FIG. 3.

Lines 20 and 21 corresponding to cable 15 for the pump A in FIG. 1 supply electric energy with a motor 29 for driving the pump A and the control circuit. A step-down transformer 22 receives and transfers the power supply to its secondary circuit. In the secondary circuit, three mechanical contacts Fa, Fb and Fc defining the contacts or switches of liquid level floats 7, 9 and 11 as shown in FIG. 1 are connected in parallel between the secondary supply lines, one of which is grounded through a line 30. Control relays 26, 23 and 25 are associated with the float contacts Fa, Fb and Fc respectively so that closing of the respective contacts energizes their associate relays. The relay 25 is further connected to the contact Fe of the lowest level sensor through a current limiting resistor 24. The current flow through the resistor 24 is adjusted to be below the level of the "pick-up" current of the relay 25 but higher than the "release" current of the relay 25. One contact 23' of the relay 23 is connected between the float contact Fa and the relay 26, the contact 26' of which is connected in series with the relay coil 26 and in parallel with the contact 23', thus forming a self-sustaining circuit.

Relay 23 has a second contact 23'' which, when operated, connects the supply to a stepping relay 27. The stepping relay 27 operates in such a manner that its contact 27' is stepped from "ON" to "OFF" or "OFF" to "ON" each time the relay 27 is energized by the closing of the contact 23''. Once stepped, the contact 27' is latched in that position after the contact 23'' opens until it closes again. Connected in series with the step-and-latch contact 27' is a time delay contact 26' of the relay 26. The closing of the contacts 27' and 26'' energizes a power relay 28 which closes its contacts 28' and 28'' disposed in power lines 20 and 21 thereby to energize the motor 29. The relay 25 responsive to the highest level float contact Fc has a contact 25' which is operated to activate the power relay 28.

Figure 5:
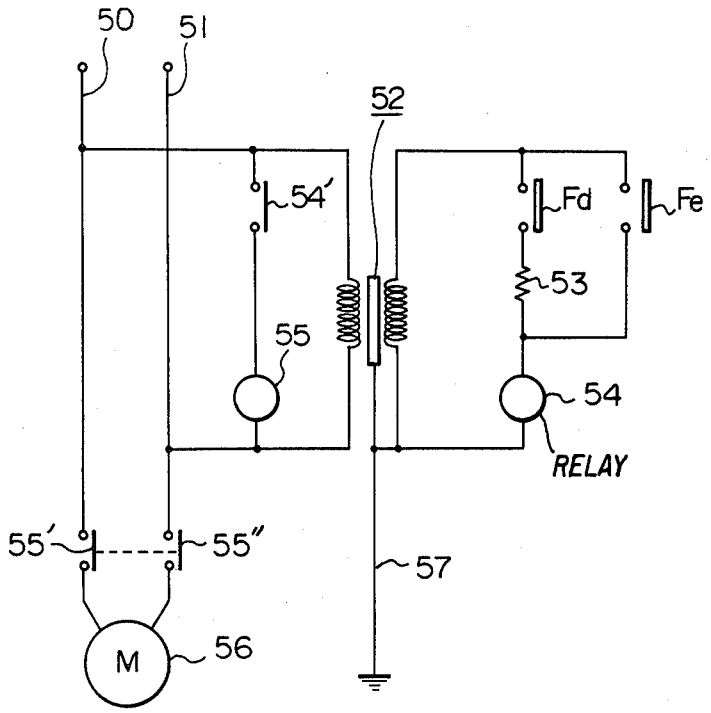
FIG. 5 is a schematic electrical diagram of a control circuit similar for the other pump shown in FIG. 1.

Referring to FIG. 5, there is shown a control circuit suitable for the subsystem B in FIG. 1. It should be understood that the control circuit shown in FIG. 5 is an example of a conventional control circuit for controlling the starting of pump B whenever the high level sensor 9' senses the liquid and continue its pumping operation until the low level sensor 7' comes out of the liquid.

The power lines 50 and 51 corresponding to the cable 15' in FIG. 1 supply the power to the motor 56 of the pump B and to the control circuit including a step-down transformer 52.

One end of the secondary winding of the transformer 52 and its insulating plate are grounded via line 57. In the secondary circuit, a float contact Fe representing the contact of the high level sensor 9' is connected, when closed, to energize a control relay 54. Connected in parallel with the float contact Fe is a float contact Fd representing the contact of the low level sensor 7' in series with a current limiting resistor 53 for limiting the current flow therethrough to have a value between the "release" and "pick-up" values of the control relay 54.

The relay 54 has a contact 54' disposed in the primary circuit of the transformer and connected, upon closing, to energize a power relay 55. Energization of the relay 55 closes its contacts 55' and 55'' disposed in the power lines 50 and 51 respectively to activate the motor 56 for pump operation.

Figure 4:
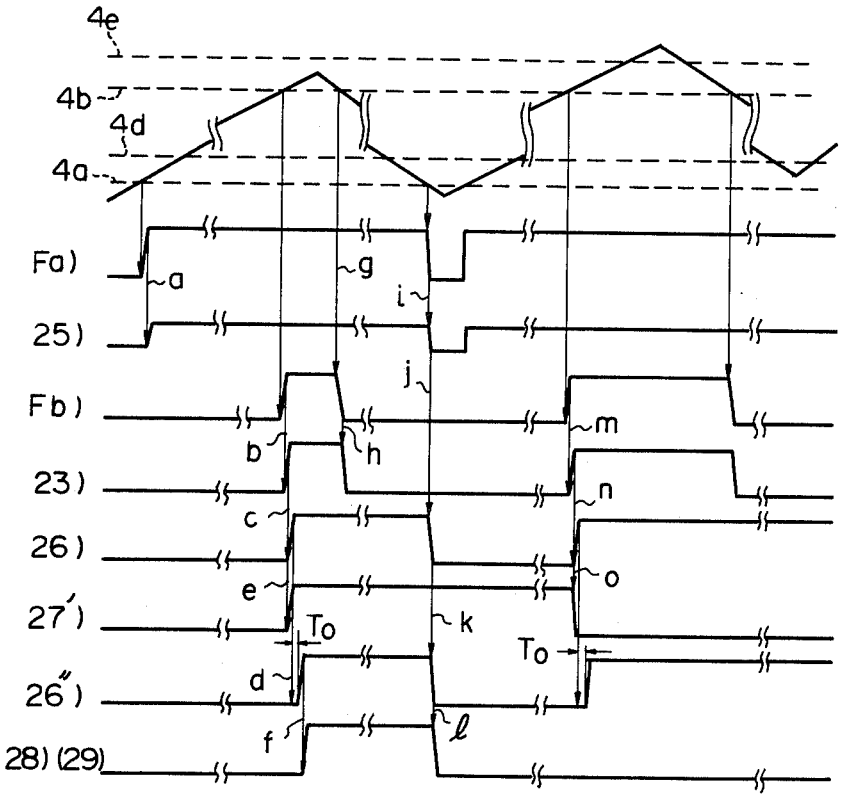
FIG. 4 is a time chart of the control circuit shown in FIG. 2 when applied to the system shown in FIG. 1.
Figure 6:
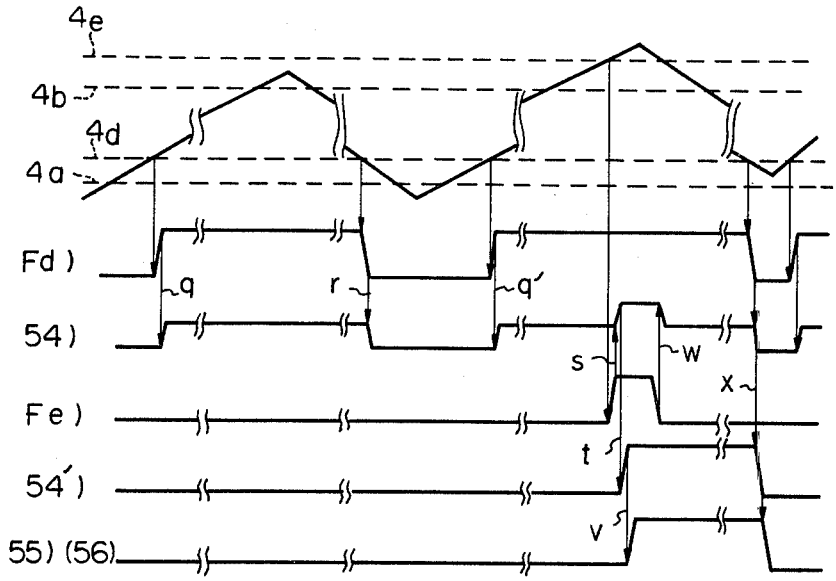
FIG. 6 is a time chart of the control circuit shown in FIG. 2 when applied to the system shown in FIG. 1.

The typical operations of the pump system in FIG. 1 wherein the subsystem A is controlled by the circuit shown in FIG. 2 whereas the subsystem B is controlled by the circuit shown in FIG. 5 will now be described with reference to FIGS. 4 and 6, illustrating a time chart of the subsystem A and the subsystem B, respectively.

It is assumed that the step contact 27' is initially in a open state and that the reservoir is empty. As liquid enters into the reservoir, the liquid level rises until it reaches a level 4*a* as shown in FIGS. 1 and 4. At this point, the low level sensor 7 for the subsystem A closes its contact Fa to permit a limited current flow in the control relay 25 through the resistor 24 as indicated by an arrow a in FIG. 4. Since the resistor 24 limits the current to a value less than the pick-up value of the relay 25, its contact 25' remains open.

A further rise of liquid to a level 4*d* causes the low level sensor 7' for the subsystem B to close its contact Fd. In a similar manner just described with reference to the subsystem A, a current determined by the resistor 53 flows into the relay 54 as indicated by an arrow q in FIG. 6 but is insufficient to close the contact 54'.

When the liquid further rises up to a level 4*b*, the high level sensor 9 for the subsystem A closes its contacts Fd (FIG. 2) to energize the control relay 23 as indicated by an arrow b in FIG. 4. The energization of the relay 23 closes one of its contacts 23'' which, in turn, activates the stepping relay 27 as indicated by an arrow e in FIG. 4. Then, the relay 27 steps the contact 27' to a closed position from an open position initially assumed. The energization of relay 23 also closes another of its contacts 23'. Since the float contact Fa connected in series with the contact 23' is closed, the relay 26 is turned on upon the closing of contact 23' as indicated by an arrow C in FIG. 4. The relay 26 will be latched in the energized state by closing its own contact 26' in series connection. With a predetermined delay as represented by TO after the activation of relay 26, another contact 26'' thereof closes. Thus, the power relay 28 is energized to close its contacts 28 and 28'' in the supply lines thereby to start the motor 29 as indicated by an arrow f in FIG. 4.

As the pumping operation of the subsystem A goes, the liquid falls below the level 4*b*. This causes the liquid sensor 9 to return its contact Fb to an open position as indicated by an arrow g in FIG. 4, thus deenergizing the auxiliary relay 23 as indicated by an arrow h. However, it should be noted that the self-sustained combination of the relay coil 26 and its contact 26' keeps the contact 26' closed until the float switch Fa opens. Further, after the stepping relay 27 is released due to the opening of the contact 23'' of the relay 23, the stepping contact is latched in the closed position until the contact 23'' closes again. Thus power relay 28 remains energized to continue the pumping operation.

As the pumping operation by the subsystem A continues, the liquid falls down to the level 4*d*. Then, the level sensor 7' for the subsystem B opens its contact Fd thereby to release the relay 54 completely as indicated by an arrow r in FIG. 6.

Further pumping operation of the subsystem A will lower the liquid down to the level 4*a* at which level the float sensor 7 for the subsystem A swings downward to open its contact Fa. As this occurs, the control relay 25 is disenergized as indicated by an arrow i. Also, the control or auxiliary relay 26 is unlatched as indicated by an arrow j to return the contact 26' to an open position as indicated by an arrow k. Thus, the power relay 28 becomes de-energized as indicated by an arrow l to stop the motor 29 and the pump operation of the subsystem A while the step contact 27' is still latched in a closed state.

As the liquid in the reservoir rises again, it will reach the level 4*d* at which the float contact Fd for the subsystem B closes resulting in the limited current flow in the control relay 54 as described. This is indicated by an arrow q' in FIG. 6.

When the liquid further rises to the level 4*b*, the float sensor 9 for the subsystem A swings upward to close its contact Fb. The closing of contact Fb activates the relay 23 as indicated by an arrow m in FIG. 4 to close the contact 23''. This is a second excitation for the relay 23 in the course of operation being described. This energizes the stepping relay 27 to step its contact 27' to an open position as indicated by an arrow o. As described, the energization of relay 23 also directs the relay 26 to be activated as indicated by an arrow n and be latched in that state by the closing of the contact 26'. After the predetermined time, the contact 26'' moves to a closed position. It should be noted that the closing of the contact 26'' lags behind the opening of the step contact 27' connected in series therewith. This delayed or staggered time relationship between the opening and closing of the contacts 27' and 26'' inhibits transient and/or erroneous energization of the power relay 28 thus preventing the pump motor 29 from being activated.

When the liquid further rises to a level 4*e*, the high level liquid sensor 9' for the subsystem B comes into operation to close its contact Fe. This applies the supply voltage directly across the control relay 54 to change its contact 54' to a closed position as indicted by arrows s and t in FIG. 6. Accordingly, the power relay 55 is turned on as indicated by an arrow v to close its contacts 55' and 55'' which, in turn, activates the motor 56 to start the pump operation of the subsystem B.

When the liquid falls below the level 4*e*, the float sensor 9' is returned to open the contact Fe as indicated by an arrow w. However, the limited current adjusted by the resistor 53 has been passing through the relay 54 and latches its contact 54 closed. The pump operation of the subsystem B continues until the liquid level drops back to the level 4*d*. Then the float contact Fd opens to release the control relay 54, as indicated by an arrow x in FIG. 6, which in turn, releases the power relay 55, thus stopping the pump operation.

In the above operation, it is assumed that the rate of liquid influx to the reservoir is less than the pumping capacity of a single pump. However, in actual practice, the inflow rate may at times be beyond the pumping capacity of a single pump. Further, any pump gets out of order at times. Therefore it is desirable to put the subsystem A into operation whenever the liquid reaches a predetermined high level because of such temporary increase in the liquid ingress or such failure of the subsystem B.

In the control circuit as illustrated in FIG. 2, the highest level float switch Fc and the associated relay 25 provide such operation. More specifically, when the liquid level rises higher than the levels 4*b* and 4*e*, and up to a level 4*c* due to the above-mentioned reasons, the float sensor 11 (FIG. 1) disposed higher than any other sensor swings upward to close its switch or contact Fc. This activates the relay 25 to close its contact 25' which, in turn, energizes the power relay 28 to initiate the pump operation. Once the relay contact 25 is operated or closed, it is latched in this position by the limited current through the resistor 24 until the low level float contact Fa closes when the liquid falls below the level 4*a*. Then, the pump operation of the subsystem A stops.

Figure 7:
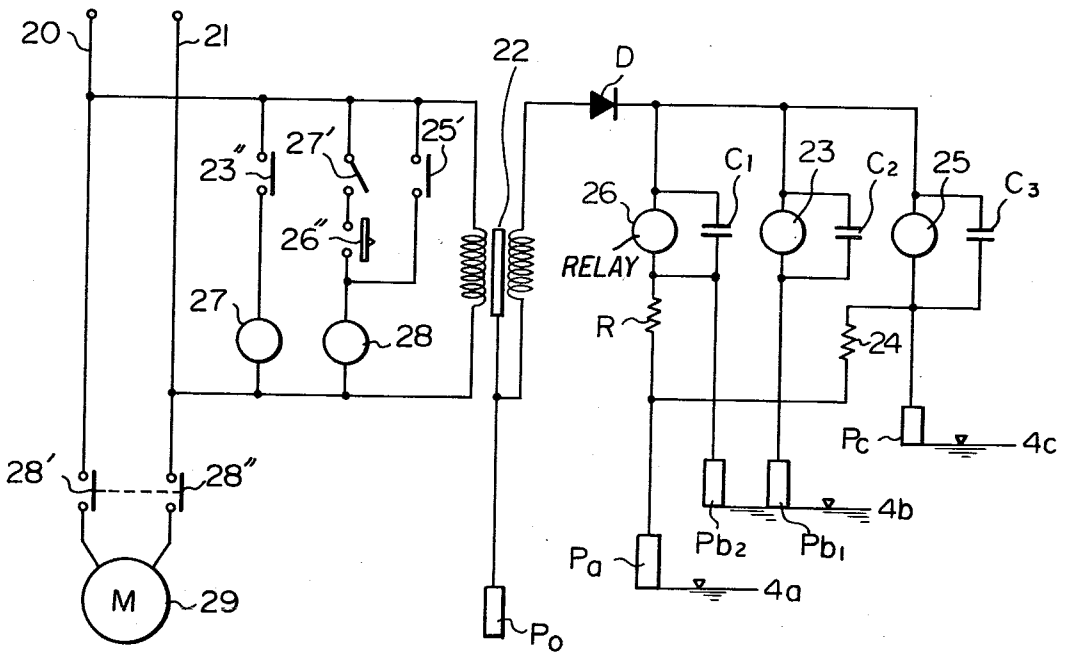
FIG. 7 is a schematic electrical diagram of a control circuit smaller to the control circuit in FIG. 2 but modified so as to be suitable for the system wherein electrode type liquid level sensors are employed.

Referring now to FIG. 7, there is shown another embodiment of a control circuit for alternately controlling the pump operation. This control circuit is similar to the circuit shown in FIG. 2. Thus, in FIGS. 2 and 7 the same reference numerals designate the same or similar components. However, the control circuit in FIG. 7 is designed to be adapted for the system employing electrode type sensors or probes as liquid level sensors. Specifically, four electrode sensors are illustrated and designated by Pa, Pb1, Pb2 and Pc.

These sensors are operably connected through the liquid to a grounded electrode Po connected to one end of the secondary winding of the step-down transformer 22. A diode D is connected to the other end of the secondary winding to produce a rectified voltage. Capacitors C1, C2 and C3 connected respectively across the control relays 26, 23 and 25 serve to smooth the rectified voltage having ripple components to prevent the malfunction of these relays. A resistor R between the relay 26 and the probe Pa is a current limiting resistor.

The operation of the control circuit in FIG. 7 may be summarized as follows. When the liquid level reaches the level 4*a* shown in FIG. 7 and also in FIG. 1, the probe Pa is grounded to the electrode Po to form a closed loop through the relay 26. However, its contact 26″ does not close because of the current limiting resistor R. A further liquid rise to the level 4*b* causes the probe Pb1 to be grounded. Thus, the relay 23 is energized to close its contact 23″ which, in turn, energizes the step relay 27 to step its contact to either an open position or a closed position as the case may be. At the same time, the probe Pb2 is also grounded to energize the relay 26. With a predetermined delay, its contact 26″ is moved to a closed position and latched in this position by the resistor R until the probe Pa comes out of the liquid. In this manner, the pump motor 29 is alternatively put into operation for each rising cycle of liquid.

Whenever the liquid reaches the level 4*c*, the highest level sensor Pc is grounded to energize the relay 25 which, in turn, closes its contact 25′ to energize the power relay 28. Once energized, the control relay 25 has been energized by the latching current through the resistor 24 and the probe Pa until the liquid drops down the level 4*a* to disconnect the probe Pa in the circuit.

From the above summary, it is understood that the control circuit shown in FIG. 7 provides the same control as the control circuit shown in FIG. 2.

Figure 8:
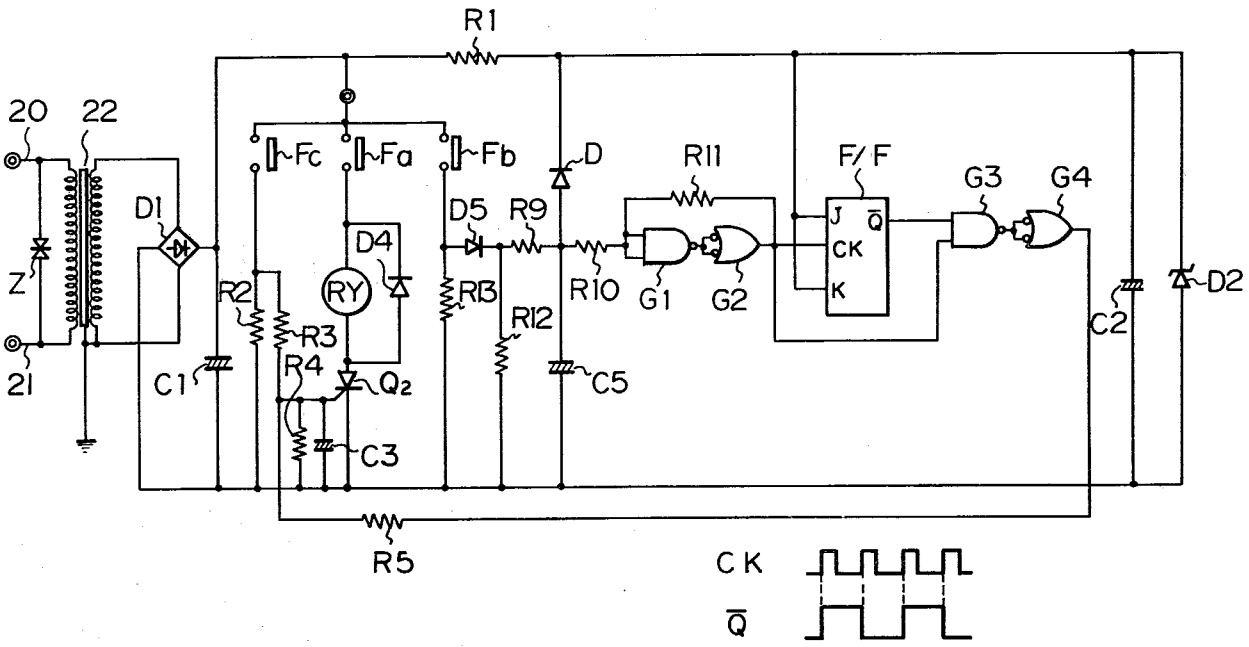
FIG. 8 is a schematic electrical diagram of another control circuit suitable for the one pump in FIG. 1 and includes a time chain for the flip flop.

Referring now to FIG. 8, there is shown still another embodiment of a control circuit suitable for the subsystem A in FIG. 1. Power supply lines 20 and 21 supply energy through a zener diode z, a step-down transformer 22, a full rectifier D1 and a smoothing capacitor C1 to the control circuit. Contacts Fa, Fb and Fc correspond to the contacts of the float sensors 7, 9 and 11 in FIG. 1, respectively. A relay RY corresponding to the power relay 28 is provided for operably connecting the supply to a pump motor (not shown) corresponding to the motor 29 in FIG. 2.

A semiconductor switch in the form of a silicon controlled rectifier (SCR) switch Q2 is connected to the relay RY and the float switch Fa so that the relay RY is activated when the SCR switch Q2 is turned on with the float switch Fa closed. The diode D4 across the relay RY is a flywheel diode as is well known in the art. The SCR switch Q2 is turned into conduction when the highest level float switch or contact Fc closes. More specifically, the closing of the contact Fc permits a current flow through a resistor R2 to establish or voltage thereacross. This voltage is applied through a resistor and a bias circuit comprising a resistor R4 in parallel with a capacitor C3 to the gate electrode of the SCR switch Q2 and triggers the SCR switch.

It is now understood that the control circuit shown in FIG. 8 starts the pump operation whenever the highest level float 11 in FIG. 1 senses the liquid and continues the operation until the lowest level float 7 comes out of the liquid.

The SCR switch Q2 is also turned on when a logic circuit to be described hereinafter provides a signal to the gate of the SCR switch. The supply voltage to the logic circuit is regulated by a capacitor C2 in parallel with a zener diode D2 and is uncoupled from the remaining circuit by a resistor R1. The logic circuit comprises a delay circuit, a plurality of gates and a bistable flip flop.

The operation of the logic circuit is as follows. When the float contact Fb closes at the liquid level 4*b*, a voltage appears across a resistor R13. This voltage enters into the delay circuit comprising diodes D3 and D5, resistors R9 and R12 and a capacitor C5. The function of the delay circuit is to stabilize the voltage and prevent the malfunction of the flip flop owing to the vibration of the float switch Fb. The stabilized output of the delay circuit is applied through a resistor R10 to a NAND gate G1 which serves as an invertor. Thus, the NAND gate G1 provides a logic "Low" or "0" level signal to a NAND gate G2 which also serves as an invertor, and in turn, provides a "1" level signal to the flip flop. A feed back resistor R11 connecting the output of the NAND gate G2 to the input of the NAND gate G1 functions to shape or sharpen the waveform.

In the present example, the flip flop comprises a J-K flip flop F/F with the J and K inputs connected to a supply line at a logic "1" level and the clock input connected to the output of the gate G2. Accordingly each time the clock input transits to a "1" level from a "0" level, the flip flop changes between the two states and provides the changed output at the Q terminal as shown in a time chain in FIG. 8. The $\overline{Q}$ output of the flip flop is connected to an input of a NAND gate G3. Another input of the NAND gate G3 is connected to the output of the NAND gate G2. When both inputs become "1", the gate G3 provides a "0" signal to a gate G4 which serves as an invertor. Then, the gate G4 provides a "1" signal or trigger signal through the resistor R5 to the gate of the SCR switch Q2 and triggers the switch into conduction to energize the power relay RY thereby to initiate the pump operation.

It is now understood that the logic circuit including the flip flop as its main component provides an alternate pump operation between the levels 4*b* and 4*a*.

While several embodiments of the invention have been shown and described, it is to be understood that various modifications can be made without departing from the spirit and scope of the invention as determined by the appended claims.

What is claimed is:

1. A pump control system employing two pumps for pumping out the liquid in a reservoir or the like wherein the one pump includes first and second sensing means for providing first or high and second or low liquid level signals, respectively, and control circuit means responsive to said first and second sensing means for controlling the one pump to be alternately energized between said first and second liquid levels and wherein the other pump includes third and fourth sensing means for providing third or high and fourth or low liquid level signals, respectively, and control circuit means responsive to said third and fourth sensing means for controlling the other pump to be energized between said third and fourth liquid levels; the improvement comprising that the control circuit means for the one pump includes step memory means having first and second states or positions, the state of said memory means being changed between the first and second states upon receipt of each of said first liquid level signals for conditioning the control circuit means to alternately initiate and inhibit the operation of the one pump upon receiving said first liquid level signal whereby said second liquid level may be positioned either higher or lower than said fourth liquid level.

2. A submersible pump adapted to pump out the liquid in a reservoir or the like and having first sensing means for sensing a first liquid level in the reservoir, second sensing means for sensing a second liquid level lower than said first liquid level, and control circuit means responsive to said sensing means for energizing the pump every other time the liquid level is between said first and second liquid levels; the improvement comprising that said control circuit means is built in said submersible pump, and includes power relay means for operably connecting a motor for driving said pump to a power supply to effect the pump operation and stepping relay means which is associated with said first sensing means and has a contact disposed in a circuit line including said power relay means, said contact being capable of changing between a close position and an open position, the close position conditioning said control circuit means to initiate the pump operation and the open position conditioning said control circuit means to inhibit the pump operation, whereby, when said control circuit means receives a first liquid level signal which is generated by said first sensing means every time the liquid rises up to said first liquid level, said contact of the stepping relay means can be alternately changed between said close and open positions to operate the pump in the every other time mode.

3. The submersible pump as claimed in claim 2 further including third sensing means for sensing a third liquid level higher than said first liquid level in the reservoir, and wherein said control circuit means further includes means responsive to said third sensing means for initiating the pump operation whenever the liquid reaches said third liquid level.

4. The submersible pump as claimed in claim 2 or 3 wherein said control circuit means further includes control relay means which is energized when the liquid level rises up to said first liquid level and said first sensing means senses the first liquid level, said control relay means having a normally open contact with is moved to a close position with a predetermined delay after the energization of its coil and which is disposed in the circuit line including said power relay means and said contact of the stepping relay means, whereby the closure of said contact of the control relay means always occurs after the switching action of said contact of the stepping relay means.

5. A first submersible pump for use with a second submersible pump and both adapted to pump out the liquid in a reservoir or the like wherein said first submersible pump has first sensing means for sensing a first liquid level in the reservoir, second sensing means for sensing a second liquid level lower than said first liquid level, and first control circuit means responsive to said first and second sensing means for energizing the first pump every other time the liquid level is between said first liquid level and said second liquid level, and wherein said second submersible pump has third sensing means for sensing a third liquid level, fourth sensing means for sensing a fourth liquid level lower than said third liquid level, and second control circuit means responsive to said third and fourth sensing means for energizing the second pump when the liquid level is between said third liquid level and said fourth liquid level;

said first control circuit means including step memory means which is associated with said first sensing means and is capable of changing between first and second states or positions, the first state conditioning said first control circuit means to initiate the pump operation and the second state conditioning said first control circuit means to inhibit the pump operation, whereby said second liquid level may be positioned either higher or lower than said fourth liquid level, whereby, said first control circuit means receives a first liquid level signal which is generated by said first sensing means every time the liquid rises up to said first liquid level, and said step memory means can be alternately changed between said first and second states so that the first and second pumps operate alternately.

6. The first submersible pump as claimed in claim 5 wherein said first control circuit means includes power relay means for operably connecting a motor for driving the first pump to a power supply to effect the pump operation, wherein said step memory means comprises a bi-stable flip-flop associated with said first sensing means and having an output capable of changing between first and second output states, wherein said first control circuit means further includes semiconductor switching means disposed in a circuit line including said power relay means and having a controlled gate connected to the output of said flip-flop, said first output state of the flip-flop triggering said semiconductor switching means and conditioning said first control circuit means to initiate the operation of the first pump, and said second output state conditioning said first control circuit means to inhibit the operation of the first pump, whereby when said first control circuit means receives a first liquid level signal which is generated by said first sensing means and occurs every time the liquid rises up to said first liquid level, said flip-flop can be alternately changed between said first and second output states.

7. The first submersible pump as claimed in claim 5 wherein said first control circuit means includes power relay means for operably connecting a motor for driving the first pump to a power supply to effect the pump operation, wherein said step memory means comprises stepping relay means associated with said first sensing means and having a contact disposed in a circuit line including said power relay means, said contact being capable of changing between a close position and an open position, the close position conditioning said first control circuit means to initiate the pump operation and the open position conditioning said control circuit means to inhibit the pump operation, whereby when said first control circuit means receives a first liquid level signal which is generated by said first sensing means and occurs every time the liquid rises up to said first liquid level, said contact of the stepping relay means can be alternately changed between said close and open positions.

8. The first submersible pump as claimed in any one of claims 5 through 7 further including further sensing means for sensing a further liquid level higher than said first liquid level in the reservoir, and wherein said first control circuit means includes means responsive to said further sensing means for initiating the operation of the first pump whenever the liquid reaches said further liquid level.

9. The first submersible pump as claimed in any one of claims 5 through 7 wherein said liquid level sensing means is of a float type.

10. The first submersible pump as claimed in any one of claims 5 through 7 wherein said liquid level sensing means is of an electrode type.

* * * * *